US006435113B1

(12) United States Patent
Miyazawa et al.

(10) Patent No.: US 6,435,113 B1
(45) **Date of Patent: *Aug. 20, 2002**

(54) INCINERATION APPARATUS AND METHOD WHICH SUPPRESS GENERATION OF DIOXINS

(75) Inventors: Kunio Miyazawa; Hideki Nagano; Satoshi Fujii; Manabu Kuroda; Takashi Yokoyama; Takaaki Kondo, all of Tokyo (JP)

(73) Assignee: NKK Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/630,538

(22) Filed: Aug. 1, 2000

Related U.S. Application Data

(63) Continuation of application No. 09/117,703, filed as application No. PCT/JP97/04474 on Dec. 5, 1997.

(30) Foreign Application Priority Data

| | | |
|---|---|---|
| Dec. 6, 1996 | (JP) | 8-326829 |
| Jun. 26, 1997 | (JP) | 9-170222 |
| Nov. 17, 1997 | (JP) | 9-315378 |
| Nov. 17, 1997 | (JP) | 9-315379 |
| Nov. 18, 1997 | (JP) | 9-316683 |

(51) Int. Cl.[7] ..... F23B 7/00; F23N 5/00

(52) U.S. Cl. ..... 110/345; 110/185; 431/18; 431/76; 95/8; 95/283; 423/240 R; 423/DIG. 5; 423/DIG. 6

(58) Field of Search ..... 110/341, 342, 110/344, 345, 185, 186, 188, 190; 431/12, 18, 76, 89, 90; 95/4, 8, 14, 273, 283; 96/417, 420, 422; 55/467, 467.1, DIG. 30, DIG. 34; 423/240 R, 240 S, DIG. 5, DIG. 6

(56) References Cited

U.S. PATENT DOCUMENTS

| | | | | |
|---|---|---|---|---|
| 4,696,685 A | * | 9/1987 | Wood | |
| 4,793,268 A | | 12/1988 | Kukin et al. | 110/344 X |
| 5,169,611 A | * | 12/1992 | Kupper et al. | |
| 5,206,176 A | | 4/1993 | Beer et al. | 110/185 X |
| 5,413,621 A | * | 5/1995 | Högner et al. | |
| 5,425,916 A | | 6/1995 | Beer et al. | 110/186 X |

(List continued on next page.)

FOREIGN PATENT DOCUMENTS

| | | |
|---|---|---|
| EP | 0 611 919 | 8/1994 |
| EP | 0 616 171 | 9/1994 |
| JP | 62-46118 | 2/1987 |
| JP | 63-104554 | 5/1988 |
| JP | 4-161849 | 6/1992 |

(List continued on next page.)

OTHER PUBLICATIONS

Patent Abstracts of Japan: vol. 1997, No. 06, JP 09 033026; Jun. 30, 1997.

*Primary Examiner*—Ljiljana Ciric
(74) *Attorney, Agent, or Firm*—Nixon & Vanderhye PC

(57) ABSTRACT

A method for decreasing the concentration of a chlorinated aromatic compound in the exhaust gas from a combustion furnace. The exhaust gas from the combustion furnace is passed through a bag filter. The concentration of the chlorinated aromatic compound in the exhaust gas is measured and the operating temperature of the bag filter is adjusted based on the measured concentration of the chlorinated aromatic compound in order to decrease the concentration of the chlorinated aromatic compound in the exhaust gas.

12 Claims, 7 Drawing Sheets

U.S. PATENT DOCUMENTS

| | | | | | |
|---|---|---|---|---|---|
| 5,500,195 | A | * | 3/1996 | Garcia-Mallol | 423/240 R |
| 5,505,766 | A | * | 4/1996 | Chang | |
| 5,514,356 | A | * | 5/1996 | Lerner | 423/240 S |
| 5,520,123 | A | | 5/1996 | Chappell et al. | 110/188 |
| 5,620,673 | A | * | 4/1997 | Herden et al. | 423/240 S |
| 5,626,086 | A | | 5/1997 | Malone | 110/190 |
| 5,746,141 | A | * | 5/1998 | Lacquaniti et al. | |
| 5,843,205 | A | * | 12/1998 | Yoshino | 95/273 X |
| 5,968,467 | A | * | 10/1999 | Karasek | 423/240 S |
| 6,027,697 | A | * | 2/2000 | Kurihara et al. | |
| 6,033,639 | A | * | 3/2000 | Odenmo | 423/240 S X |
| 6,189,460 | B1 | * | 2/2001 | Abe et al. | 110/185 |

FOREIGN PATENT DOCUMENTS

| | | | |
|---|---|---|---|
| JP | 4-208306 | | 7/1992 |
| JP | 4-288405 | | 10/1992 |
| JP | 5-99411 | | 4/1993 |
| JP | 5-312796 | | 11/1993 |
| JP | 7-332642 | | 12/1995 |
| JP | 8-110027 | | 4/1996 |
| JP | 8-131775 | * | 5/1996 |
| JP | 10-103647 A | * | 4/1998 |
| KR | 1995-0013977 | | 7/2001 |
| WO | WO 88/06698 | | 9/1988 |

* cited by examiner

INCINERATION APPARATUS AND METHOD WHICH SUPPRESS GENERATION OF DIOXINS

This is a continuation of application Ser. No. 09/117,703, filed Aug. 4, 1998, now pending which was filed as PCT/JP97/04474 filed Dec. 5, 1997 the entire content of which is hereby incorporated by reference in this application.

TECHNICAL FIELD

The present invention relates to an incineration apparatus and method which can suppress the generation of dioxins.

BACKGROUND ART

It has been confirmed that dioxins which are extremely poisonous are generated and discharged from the incineration apparatus for municipal waste, industrial waste and the like. Conventionally, in order to suppress the generation of dioxins, the amount of carbon monoxide (CO) generated is measured, and the combustion is controlled such that the measured amount of CO is reduced. Dioxins are a kind of hydrocarbon, and they are believed to be generated from incompletely combusted matter and chlorine in the incineration step. CO is an index of the combustibility, that is to say, the generation of incompletely combusted matter.

Japanese Patent Application KOKAI Publication No. 5-99411 (to be referred to as "prior art document 1") discloses an example of the combustion control technique using the CO generating amount as an index. The prior art document 1 shows that the generation of incompletely combusted matter such as dioxins can be suppressed more effectively by controlling the combustion so as to reduce the amount of CO generated. A waste incineration apparatus, to which the technique disclosed in the prior art document 1 is applied, includes a control amount arithmetic unit and a supply control means. The control amount arithmetic unit judges the excessive or insufficient amount of water sprayed into the combustion furnace, and of primary air supplied to the combustion furnace, from the temperature of the furnace and the amount of CO generated. Then, on the basis of these judgments, supply control signals for above amounts are generated. The supply control means serves to adjust the amount of water sprayed and the amount of primary air, in accordance with the supply control signals therefor.

Japanese Patent Application KOKAI Publication No. 4-288405 (to be referred to as "prior art document 2") discloses another example of the controlling method carried out with reference to the amount of CO generated as an index. In the prior art document 2, the exhaust gas from the waste combustion furnace is made to pass through a bag filter, and the amount of CO generated in the exhaust gas is measured. Thus, in this method, the temperature of the inlet of the bag filter is controlled in response to the measured amount of CO generation, so as to decrease the amount of dioxins in the exhaust gas.

Japanese Patent Application KOKAI Publication No. 5-312796 discloses a semi-continuous monitoring device for measuring the concentration of chlorinated aromatic compounds in exhaust gas, which correlate well with dioxins. In this device, the exhaust gas is subjected to a pre-treatment so as to remove coexistent moisture and dusts from the gas, and then is made to pass through an adsorption tube. Thus, chlorinated aromatic compounds, such as chlorobenzenes, contained in the exhaust gas are adsorbed on the adsorption tube to be concentrated. Then, the chlorobenzenes are detected with gas chromatography.

However, application of the amount of CO generated to an index for the control of combustion, as in the waste incineration apparatus disclosed in prior art document 1, may not always be accepted in all cases but be accepted in only limited cases.

In more detail, application of the CO generation amount to an index for the control of combustion is principally unreasonable for the following reasons.

That is, incompletely combusted matter generated when a combustible such as waste is burned, can be mainly divided into fatty compounds, aromatic compounds and chlorinated materials of those compounds. Generally or theoretically, for example, the bond dissociation energy for a carbon-carbon bond is lower in the aliphatic compounds than in the aromatic compounds. This is due to the resonance stabilization property of the aromatic compounds. Thus, the aliphatic compounds have more easily dissociative bonds, and therefore are more easily combustible.

If the combustibility is low because of a low temperature in the furnace due to the variation in the quality of waste or the like under a constant amount of primary air, incomplete combustion occurs and the CO concentration increases. In this case, it is estimated that both the aliphatic compounds and the aromatic compounds are combusted, and that the concentration of the incompletely combusted matter is high.

Further, if the combustibility is high because of 15 a high temperature in the furnace under a constant amount of primary air, the shortage of the primary air occurs, and the CO concentration increases. In this case, the aliphatic compounds, which are more easily combustible, burn with a priority over the aromatic compounds. The aromatic compounds therefore remain unburned in relatively high amount.

Thus, the reason the CO concentration starts to increase slightly from a minimum point, at the high temperature of the furnace, is that the shortage of the primary air occurs due to the combustion of the aliphatic compounds with priority. It is expected that the increase in the CO concentration is not mainly due to the decomposition and combustion of the aromatic compounds which can generate dioxins. Thus, the increase in the CO concentration may indicate the shortage in the primary air, but may not always be an index of the generation or increase of incompletely combusted matter of the aromatic compounds or the like.

Further, in the waste incineration apparatus disclosed in prior art document 2, changes in the concentrations of dioxins are significantly influenced by the operating temperature of the bag filter.

The lower the operating temperature of the bag filter is, the smaller the amount of the exhausted dioxin is. However, combustion exhaust gas generated from a waste incineration apparatus contains harmful components such as $SO_X$ and HCl other than dioxins. If the bag filter is operated at a low temperature of about 160 to 200° C. so as to collect dioxins by the bag filter, there raises a high possibility that the facilities such as the bag filter and pipes are corroded by harmful components such as $SO_X$ and HCl.

Further, when the bag filter is operated at a low exhaust gas temperature, for example, moisture in the exhaust gas condenses into water, and sulfuric acid and HCl generated by the chemical reaction of part of SOx dissolves into the water. Thus, when the bag filter is operated at a low temperature, the facilities such as the bag filter and the pipes may be corroded. In order to avoid this, when the concentration of dioxins in the exhaust gas which are generated by the combustion of waste in the incineration furnace is low, it is necessary to operate the bag filter such that the exhaust gas temperature at the inlet of the bag filter becomes as close as possible to a temperature of 200° C. which is conventional.

Further, the techniques disclosed in the prior art documents 1 and 2 entails the following drawback.

In the case of only the CO concentration being monitored as an index, the measurement of the CO concentration is easy. However, the CO concentration value does not contain any information regarding the chlorination reaction of aromatic compounds. Therefore, any information which directly reflects the chlorinated aromatic compounds such as dioxins cannot be obtained. The control of the combustion in such a way as to reduce the amount of CO generated can decrease the amount of incompletely combusted matter on the whole. In other words, the control of combustion with reference to the CO concentration as an index is effective if the level of the amount of incompletely combusted matter generated is high, as in the case of waste incineration apparatus manufactured several years ago. However, the control of combustion with reference to the CO concentration as an index cannot further suppress or reduce the amount of incompletely combusted matter generated, especially chlorinated aromatic compounds such as dioxins, if the level of the amount of incompletely combusted matter generated is extremely low (for example, CO concentration is equal to or less than 50 ppm), as in the case of the waste incineration apparatus of the latest type.

The present invention has been proposed in consideration of the above-described drawbacks of the conventional techniques, and the object of the invention is to provide an incineration apparatus capable of achieving the further suppression and reduction of dioxins, which cannot be achieved by the control of combustion with reference to the CO concentration as an index.

DISCLOSURE OF INVENTION

The authors of the present inventions conducted intensive studies and research in order to solve the above-described drawbacks of the conventional technique, and they have found that further suppression and reduction of dioxin can be achieved by setting the amount of chlorinated aromatic compounds generated, as an index, in place of the CO concentration.

Therefore, according to the present invention, there is provided an incineration apparatus which can suppress the generation of dioxins, comprising: a combustion furnace for burning a combustible in combustion air within the furnace; a chlorinated aromatic compound measuring means for measuring an amount of a chlorinated aromatic compound generated in the combustion furnace; and a control means for monitoring the amount of the chlorinated aromatic compound generated, obtained by the measuring means, and varying operating conditions of the combustion furnace on the basis of the monitored result, such as to decrease the amount of the chlorinated aromatic compound generated in the combustion furnace.

With regard to the present invention, it is preferable that the control device should further comprise: an arithmetic unit for judging the excessive or insufficient amount of a variable related to combustion of the combustible to produce a control signal on the basis of data on the amount of the generated chlorinated aromatic compound obtained by the chlorinated aromatic compound measuring device, and an adjuster means for adjusting the variable in accordance with the control signal, such as to decrease the amount of the chlorinated aromatic compound generated in the combustion furnace.

Further, with regard to the present invention, it is preferable that the variable related to the combustion of the combustible should be the combustible supplied to the combustion furnace and/or the combustion air supplied to the combustion furnace.

The present invention further provides an incineration apparatus which can suppress the generation of dioxins, comprising: a combustion furnace for burning a combustible in combustion air within the furnace; a chlorinated aromatic compound measuring means for measuring an amount of a chlorinated aromatic compound generated in the combustion furnace; an arithmetic unit for judging the excessive or insufficient amount of the supplied combustible and/or the supplied combustion air to produce a control signal on the basis of data on the amount of the generated chlorinated aromatic compound measured by the measuring means; and a supply amount adjusting means for adjusting the combustible supply amount and/or the combustible air amount in accordance with the control signal, such as to decrease the amount of the chlorinated aromatic compound generated in the combustion furnace.

With regard to the present invention as described above, it is preferable that it should further comprise oxygen measuring means for measuring an oxygen concentration in the combustion furnace, and/or a furnace interior temperature measuring means for measuring a furnace interior temperature of the combustion furnace, while the arithmetic unit should judge the excessive or insufficient amount of the supplied combustible and/or the combustion air to produce a control signal on the basis of data of the amount of the generated chlorinated aromatic compound measured by the chlorinated aromatic compound measuring means, the data of the amount of the oxygen concentration measured by the oxygen measuring means and/or the data of the furnace interior temperature measured by the furnace interior temperature measuring means.

With regard to the present invention, it is preferable that the chlorinated aromatic compound measuring device measure the amount of the generated chlorinate aromatic compound in substantially real time.

The present invention further provides an incineration apparatus which can suppress the generation of dioxins, comprising: a combustion furnace; a bag filter for filtering an exhaust gas from the combustion furnace, and/or an activated carbon supply means for supplying an activated carbon into the exhaust gas; a chlorinated aromatic compound measuring means for measuring an amount of a chlorinated aromatic compound in the exhaust gas; and the adjusting means for adjusting an operating temperature of the bag filter and/or an amount of activated carbon supplied by the activated carbon supply means on the basis of the amount of the chlorinated aromatic compound measured by the measuring means, such as to decrease the amount of the chlorinated aromatic compound in the exhaust gas.

With regard to the present invention, it is preferable that the measuring means should include a feedback control means.

The present invention further provides an incineration method of combusting a combustible in combustion air within a combustion furnace, which can suppress the generation of dioxins, the method comprising the steps of: measuring an amount of a chlorinated aromatic compound generated in the combustion furnace; and monitoring the amount of the generated chlorinated aromatic compound and varying operating conditions of the combustion furnace on the basis of a monitoring result, such as to decrease the amount of the chlorinated aromatic compound generated in the combustion furnace.

With regard to the present invention, it is preferable that in the varying step, the excessive or insufficient amount of a variable related to combustion of the combustible should be judged on the basis of data on the amount of the chlorinated aromatic compound generated in the furnace, and the variable should be adjusted in accordance with the judgment, such as to decrease the amount of the chlorinated aromatic compound generated in the combustion furnace.

The present invention provides an incineration method of burning a combustible in combustion air within a combustion furnace, which can suppress the generation of dioxins, comprising the steps of: measuring an amount of a chlorinated aromatic compound generated in the combustion furnace; judging the excessive or insufficient amount of the combustible supplied to the combustion furnace and/or the amount of combustion air supplied to the combustion furnace on the basis of the data on the measured amount of the generated chlorinated aromatic compound; and adjusting the combustible supply amount and/or the combustible air amount on the basis of a judgment on the excessive or insufficient amount of the supplied combustible and/or the supplied combustion air, such as to decrease the amount of the chlorinated aromatic compound generated in the combustion furnace.

With regard to the present invention, it is preferable that in the measuring step, an oxygen concentration in the combustion furnace and a furnace interior temperature should be measured as well as the amount of the chlorinated aromatic compound generated within the combustion furnace; and in the judging step, the excessive or insufficient amount of the supplied combustible and/or of the supplied combustion air should be judged on the basis of the data of the amount of the generated chlorinated aromatic compound, the oxygen concentration and/or the furnace interior temperature.

With regard to the present invention, it is preferable that it should comprise the steps of: judging the excessive or insufficient amount of water sprayed in the combustion furnace on the basis of the measured data of the amount of the generated chlorinated aromatic compound; and adjusting the amount of water sprayed on the basis of a judgment on the excessive or insufficient amount of water sprayed, such as to decrease the amount of the chlorinated aromatic compound generated in the combustion furnace.

With regard to the present invention, it is preferable that in the judging step, the excessive or insufficient amount of water sprayed in the combustion furnace should be judged on the basis of the measured data of the amount of the generated chlorinated aromatic compound and also the measured data of the furnace interior temperature of the combustion furnace.

The present invention further provides an incineration method which can suppress the generation of dioxins, and of passing an exhaust gas from a combustion furnace through a bag filter and/or supplying activated carbon into the exhaust gas, the method comprising the steps of: measuring a concentration of a chlorinated aromatic compound in the exhaust gas; and adjusting an operating temperature of the bag filter and/or an amount of the activated carbon supplied into the exhaust gas on the basis of the concentration of the chlorinated aromatic compound, such as to decrease the concentration of the chlorinated aromatic compound in the exhaust gas.

With regard to the present invention, it is preferable that the adjusting step should employ feedback control.

With regard to the present invention, it is preferable that the feedback control should measure the concentration of the chlorinated aromatic compound periodically, and adjusts the operating temperature of the bag filter and/or the amount of the supplied activated carbon so that the measured concentration of the chlorinated aromatic compound is equal to or less than a preset level.

The present invention further provides a combustion method which can suppress the generation of dioxins, and of passing an exhaust gas from a combustion furnace through a bag filter and/or supplying activated carbon into the exhaust gas, the method comprising the steps of: measuring a concentration of a chlorinated aromatic compound in the exhaust gas; estimating a concentration of dioxins in the exhaust gas on the basis of the measured concentration of the chlorinated aromatic compound; and adjusting the operating temperature of the bag filter and/or an amount of the activated carbon supplied into the exhaust gas on the basis of the estimated concentration of the dioxins, such as to decrease the concentration of the dioxins in the exhaust gas.

With regard to the present invention, it is preferable that the chlorinated aromatic compound should be at least one of dioxins.

With regard to the present invention, it is preferable that the chlorinated aromatic compound should be at least one of chlorobenzenes or at least one of chlorophenols.

With regard to the present invention, it is preferable that the chlorinated aromatic compound should be at least tetrachlorobenzene or pentachlorobenzene.

BEST MODE OF CARRYING OUT THE INVENTION

Examples of the mode of the present invention will now be described with reference to accompanying drawings.

Figure 1:
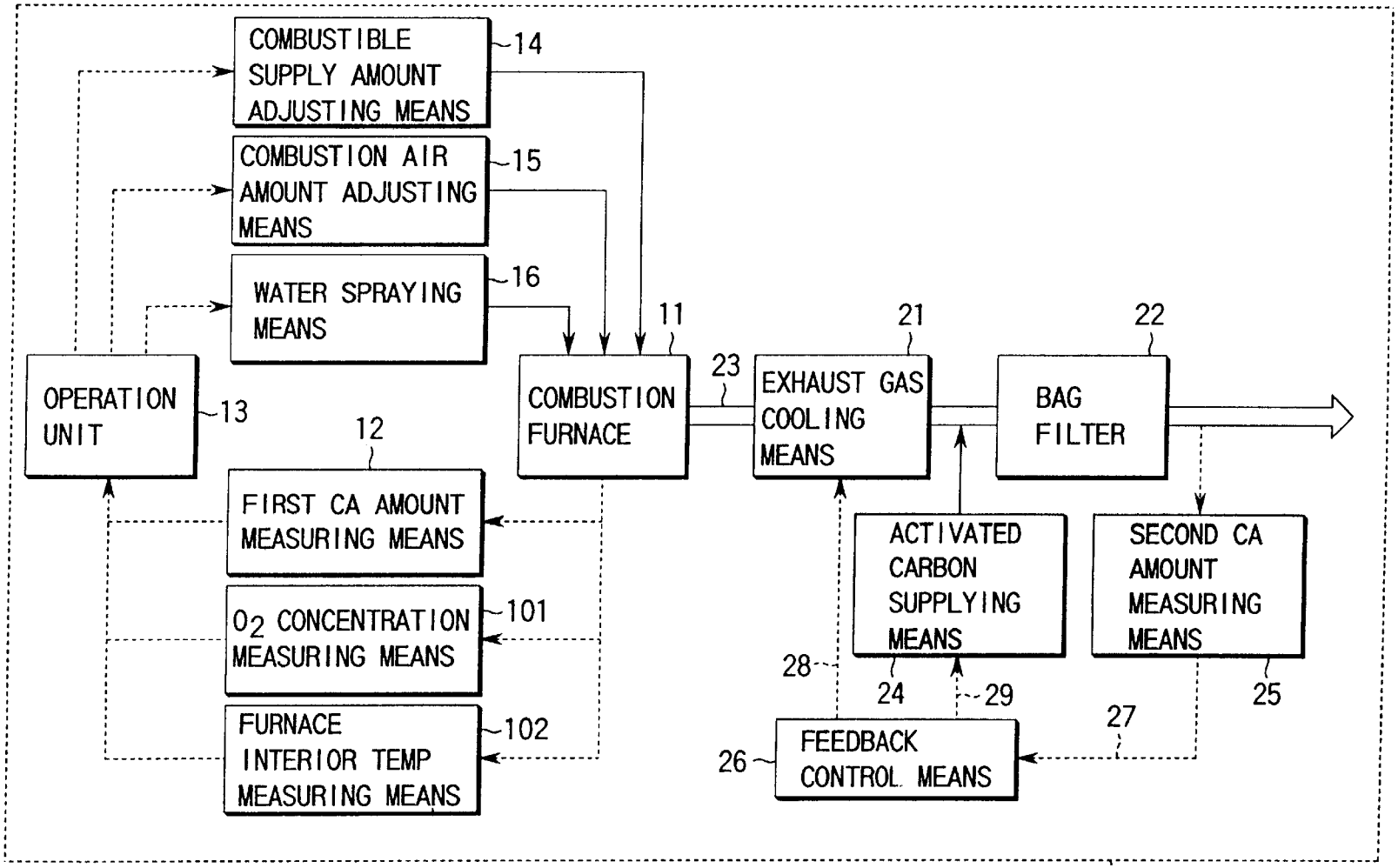
FIG. 1 is a schematic view of an embodiment of the waste incineration apparatus according to the present invention.

FIG. 1 is a schematic diagram of an embodiment of the incineration apparatus of the present invention.

An incineration apparatus 10 according to the present embodiment includes an incineration furnace 11 within which combustibles are burned in combustion air.

The combustibles include any matters which may contain organic compounds, such as house waste and scraps.

The type of the furnace of the combustion furnace 11 is, for example, a stoker type or fluid bed type, but is not particularly limited.

The combustion furnace 11 has exhaust gas cooler 21 and a bag filter 22 which are connected in this order. An exhaust gas 23 exhausted from the combustion furnace 11 is discharged to the outside of the combustion apparatus 10 through the exhaust gas cooling means 21 and the bag filter 22. Activated carbon supply 24 is connected between the exhaust gas cooler 21 and the bag filter 22. Activated carbon is supplied from the activated carbon supply means 24 into the exhaust gas 23.

The combustion furnace 11 is provided with the first measuring device for the amount of chlorinated aromatic compounds (CA), oxygen ($O_2$) concentration measuring means 101 and/or furnace interior temperature measuring means 102. Further, the second measuring device 25 for the CA amount is provided at the exit of the bag filter.

Chlorinated aromatic compounds means aromatic compounds containing at least one chloride atom as a substituent. The chlorinated aromatic compounds include dioxins, chlorobenzenes and chlorophenols. The chlorinated aromatic compounds are correlated with dioxins.

Dioxins is a general term covering a total of 210 homologues and isomers of polychlorinated dibenzo-p-dioxin and polychlorinated dibenzofuran.

Chlorobenzenes are monocyclic aromatic compounds containing at least one chloride atom as a substituent, such as monochlorobenzene, dichlorobenzene, trichlorobenzene, tetrachlorobenzene and pentachlorobenzene.

Chlorobenzenes are monocyclic aromatic compounds containing at least one chloride atom and hydroxyl group as a substitutent, such as monochiorophenol and dichlorophenol.

The chlorobenzenes and chlorophenols are incompletely combusted components of combustibles including waste. They are highly correlated with dioxins because the chemical structures of these compounds are partially similar to that of the dioxins, and the behavior in formation reaction of compounds are approximately similar to that of the dioxins. For this reason, if the concentration of dioxins, chlorobenzenes or chlorophenols is measured in advance, the concentration of dioxins can be estimated. It is preferable that the concentration of tetrachlorobenzene or pentachlorobenzene should be measured, in order to estimate the concentration of dioxins.

The first CA amount measuring device 12 and the second CA amount measuring device 25, both for measuring the amount of chlorinated aromatic compounds generated, each should preferably be a real-time automatic analyzing meter (quick automatic analyzing meter) which can measure in substantially real-time. Further, the measuring devices 12, 25 should be of the type capable of measuring a very low amount of chlorinated aromatic compounds such as dioxins which is exhausted from a recent waste incineration apparatus, that is, an dioxin-suppressing furnace.

The above-described conditions can be achieved by, for example, measuring means to which a laser multiple photon ionization mass spectrometry technique is applied. In the laser multiple photon ionization mass spectrometry technique, a gas sample is introduced into a vacuum through a nozzle having a small pore diameter, and the sample is then cooled down to near absolute zero degree through adiabatic expansion. This operation is called super-sonic molecule jet. In this state created by the super-sonic molecule jet, the molecular movement including vibration and rotation is suppressed, therefore ionization occurs only by the irradiation of a laser having a wavelength in a very narrow band which corresponds to the chemical structure of each compound. By connecting the above-described mass spectrometer to the apparatus, only the ionized compound molecules can flow to the mass spectrometer to be detected. As a result, even for an exhaust gas sample in which various compounds coexist the object compound of the measurement can be separated and detected (determined) accurately without any influence from other compounds. Usable examples of the laser are a dye laser excited by a YAG laser or an excimer layer, a titanium sapphire laser and an optical parametric laser, which is an ultraviolet variable laser.

The type of the mass spectrometer is not particularly limited. It may be various types such as quadruple, double convergence and flight-time. The flight time type is preferable in consideration of operability and stability. Usually, the introduction can be performed in several milliseconds to several hundred microseconds, the laser irradiation can be done in several tens of nanoseconds to hundred femtoseconds, and the detection with the flight-time type mass spectrometer can be carried out within several tens of microseconds to several hundred microseconds. Thus, the whole measurement can be finished within ten milliseconds at maximum, and therefore carried out in real time.

The oxygen concentration and the furnace interior temperature which are measured in the combustion furnace 11 may be variables for estimating the cause for incomplete combustion. The $O_2$ concentration measuring means 101 and the furnace interior temperature measuring means 102 should preferably be capable of carrying out a measurement substantially continuously as usually employed.

First, the suppression of the generation of dioxins with use of the first CA measuring device 12 equipped in the combustion furnace 11 will now be described.

The incineration apparatus 10 includes control for optimizing the operating condition of the incineration apparatus 10. The control monitors the amount of CA generated, the oxygen concentration and/or the furnace interior temperature, which are measured by the above measuring devices 12, 101 and/or 102. Then, on the basis of the monitoring result, the control optimizes the operating conditions of the incineration apparatus 10, that is, for example, the amount of combustible supplied, the amount of combustion air, the amount of water sprayed, and the moving speed of each fire grate of stoker type combustion furnace and the like. In other words, the control serves to judge the excessive or insufficient amount of variables related to the combustion of combustibles in the incineration apparatus 10. The variables are such as the supplied combustible and the supplied combustion air. The judgement will be done on the basis of the amount of CA generated, the oxygen concentration and/or the furnace interior temperature, which are measured by the measuring devices 12, 101 and/or 102. Then, the control controls those variables to decrease the amount of CA generated in the combustion furnace 11.

In this embodiment, the case in which the amount (rate) of combustible supplied and the amount of combustion air are adjusted will be described.

An arithmetic unit 13 is connected to the measuring devices 12, 101 and 102 in such a way that output data can be transmitted from each measuring device to the unit 13. To the arithmetic unit 13, the data of the generated amount of at least one chlorinated aromatic compound (for example, 2,8-dichlorodibenzofuran) measured by the measuring device 12, and the data of the oxygen concentration in the combustion furnace 11 measured by the measuring device 101 and/or the data of the furnace interior temperature measured by the measuring device 102, (above data as a whole will be referred to as "measurement amount data" hereinafter) are transmitted. The arithmetic unit 13 judges the excessive or insufficient amount of variables related to the combustion of combustible in the combustion furnace 11, such as the supplied combustible and the supplied combustion air, on the basis of the measurement amount data to generate a control signal appropriate for the state. Further, if the combustion furnace is equipped with a water spraying mechanism for adjusting the temperature of the furnace, it is possible for the unit 13 to be further related to a water spray amount adjuster 16. The adjuster 16 are for adjusting the amount of water sprayed to the combustion furnace 11, which is related to the combustion of combustible. The adjuster 16 is connected to the unit 13 in such away that a control signal produced in the arithmetic unit 13 can be transmitted to the adjuster 16.

Combustible supply amount adjuster 14 may be combustible supply capable of adjusting the amount of combustible in the combustion furnace 11 and the combusting state, such as the interval of charges of combustible hoppers for charging combustible into the combustion furnace, the dust supplying pusher rate for supplying charged combustible to a fire grate, and the fire grate rate for adjusting the combustion rate of the combustible on a fire grate. Further, combustion air amount adjuster 15 may be an adjustment valve provided on a piping system for transferring the primary combustion air and/or the second combustion air when, for example, the primary combustion air and/or the second combustion air are supplied into the combustion furnace 11 with a pump. Water spray amount adjuster 16 may be an adjustment valve provided on the piping system for transferring water when, for example, water is supplied into the combustion furnace 11 with a pump.

A fine control of the process of combusting combustible in the furnace can be achieved by applying a non-linear control or a fuzzy control to the arithmetic means which produce signals to above adjusting means. This is because the process of combusting is a multivariable interference system having non-linear characteristics. On the fuzzy control, in particular, has a characteristic that the control rule can be described in language, and parameters can be easily adjusted.

TABLE 1 shows a specific example of the procedure of controlling and adjusting the combustion supply amount and/or combustion air amount by the arithmetic unit 13, on the basis of the measurement amount data. TABLE 1 also show a specific example of the arithmetic method according to the procedure. First, it is judged if the combustion state at present, satisfies one of the conditions characterized by the parameters on combustion state in TABLE 1. If one of the conditions is satisfied, the control indicated in the operation section in TABLE 1 will be executed. As a result of execution, in accordance with a preset increment or decrement for each condition, the combustible supply amount adjuster 14 and/or combustion air amount adjuster 15 are adjusted.

TABLE 1

Control method of combustible supplying amount and/or combustion air amount

| Parameters on combustion state | | | | Operation | | | |
|---|---|---|---|---|---|---|---|
| Rule | Chlrorinated aromatic compound generated amount | $O_2$ | Furnace interior temperature | (1) Combustion air amount | (2) Combustible supply amount | (3) Combustion air amount | (3) Combustible supply amount |
| 1 | low | | — | maintained | maintained | maintained | maintained |
| 2 | high | | high or low | decrease | increase | decrease | increase |
| 3 | high | | high or low | increase | decrease | increase | decrease |

In TABLE 1, it is supposed that at least one of the oxygen ($O_2$) concentration and the furnace interior temperature is taken in the arithmetic unit 13. Further, in the [operation] column of TABLE 1, item (1) indicates the adjusting method for the case where the operating amount is only the combustion air amount, item (2) for the case where the operating amount is only the combustible supply amount, and item (3) for the case where the operating amount includes the combustion air amount and the combustible supply amount.

Rule 1 is that the combustion air amount and the combustible supply amount are not adjusted. This is because when the measured concentration of chlorinated aromatic compounds is low, a normal combustion is proceeding. Rule 2 is that the amount of combustion air supplied into the furnace is decreased, and/or the amount of combustible supplied is increased, in order to recover the combustion state. This is because when the concentration of chlorinated aromatic compounds is high, and the oxygen concentration is high or the furnace interior temperature is low, the combustion state is not activated due to excessive oxygen. Rule 3 is that the amount of combustion air supplied into the furnace is increased, and/or the amount of combustible supplied is decreased, in order to recover the combustion state. This is because when the concentration of chlorinated aromatic compounds is high, and the oxygen concentration is low or the furnace interior temperature is high, the combustion state is not activated due to the shortage of oxygen.

A specific example of the operating method on the basis of these control rules will now be described. In this example the chlorinated aromatic compound generated amount and the oxygen concentration are used as the measurement amounts, and the combustion air amount of the item (1) of TABLE 1 is used as the operating amount.

Figure 2:
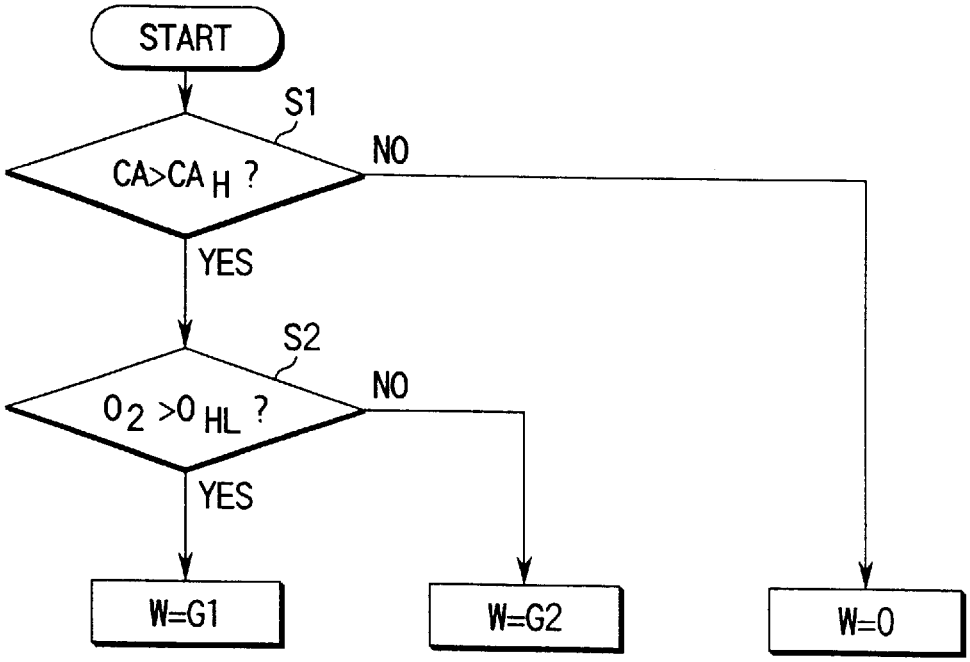
FIG. 2 is a schematic diagram of an example of the flowchart of the controlling steps in the waste incineration method according to the present invention.

FIG. 2 is a schematic diagram of flowchart showing the conditions of TABLE 1. As shown in the figure, it is judged by flowing the flowchart from START in a constant cycle that each condition of S1 and S2 is satisfied.

At the final stage, the correction amount W is determined, and the present value $U_k$ of the combustion air amount is obtained from the correction amount W and the previously determined value $U_{k-1}$ of the combustion air amount.

In FIG. 2, CA represents the concentration of chlorinated aromatic compound, and $O_2$ represents the oxygen concentration. Further, $CA_H$ is the adjustment parameter to judge the concentration of chlorinated aromatic compound is above an upper limit, and $O_{HL}$ is a parameter to judge the $O_2$ concentration is high or low. $G_1$ and $G_2$ are adjustment parameters which give a decrement and an increment in the amount of combustion air, respectively.

The control of the amount of combustion air will now be described with reference to FIG. 2.

In step S1, a judgement is made on a condition, CA (the concentration of a chlorinated aromatic compound)>$CA_H$ (the upper limit value of the concentration of the chlorinated aromatic compound). If the condition is not satisfied, W is set to 0 in accordance with the Rule 1 of TABLE 1. If the condition is satisfied, the operation proceeds to step S2. In step S2, a judgement is made on a condition, $O_2$ (the oxygen concentration)>$O_{HL}$ (the value to judge the oxygen concentration is high or low). If the condition is satisfied, W is set to $G_1$ in accordance with the Rule 2 of TABLE 1. If the condition is not satisfied, W is set to $G_2$ in accordance with the Rule 3 of TABLE 1.

Then, the correction amount W is determined. The present value $U_k$ of the amount of combustion air is obtained from the correction amount W and the previous value $U_{k-1}$, based on the following equation:

$$U_k=U_{k-1}+W$$

As described above, the optimal combustion air amount $U_k$ for suppressing the generation of chlorinated aromatic compound, that is, dioxins, in the combustion furnace 11 is obtained.

TABLE 2 shows a specific example of the procedure of controlling and adjusting the water spraying amount by the arithmetic unit 13 from the measured concentration of a chlorinated aromatic compound and the furnace interior temperature, as well as a specific example of the arithmetic method according to the procedure, in the case where a water spraying mechanism is provided in the combustion furnace 11. First, it is judged if the present combustion state satisfies one of the conditions characterized by the parameters on combustion state in TABLE 2. If one of the conditions is satisfied, then the control indicated in the operation section in TABLE 2 will be executed. As a result of the execution, in accordance with a preset increment or decrement for each condition, the water spray amount adjusting means 16 is adjusted.

TABLE 2

| Control method of water spray amount | | | |
|---|---|---|---|
| Parameters on combustion sate | | | |
| Rule | Chlorinated aromatic compound generated amount | Furnace temperature | Operating water spray amount |
| 1 | high | low | decrease |
| 2 | low | high | increase |

Rule 1 is that the combustion state is recovered by decreasing the water spray amount. This is because when the measured concentration of chlorinated aromatic compounds is high, and the interior temperature of the combustion furnace is low, the combustion balance is destroyed as the interior of the furnace is excessively cooled down by water spray.

Rule 2 is that the amount of water sprayed is increased. This is because when the concentration of chlorinated aromatic compounds is low, and the furnace interior temperature is high, the combustion state is normal, but it is necessary to prevent the corrosion of the furnace wall due to high temperature.

A specific example of the operating method on the basis of above control rules will now be described. In this example, the concentration of a chlorinated aromatic compound and the furnace interior temperature are used as the measurement amount, and the water spraying amount is used as the operating amount.

Figure 3:
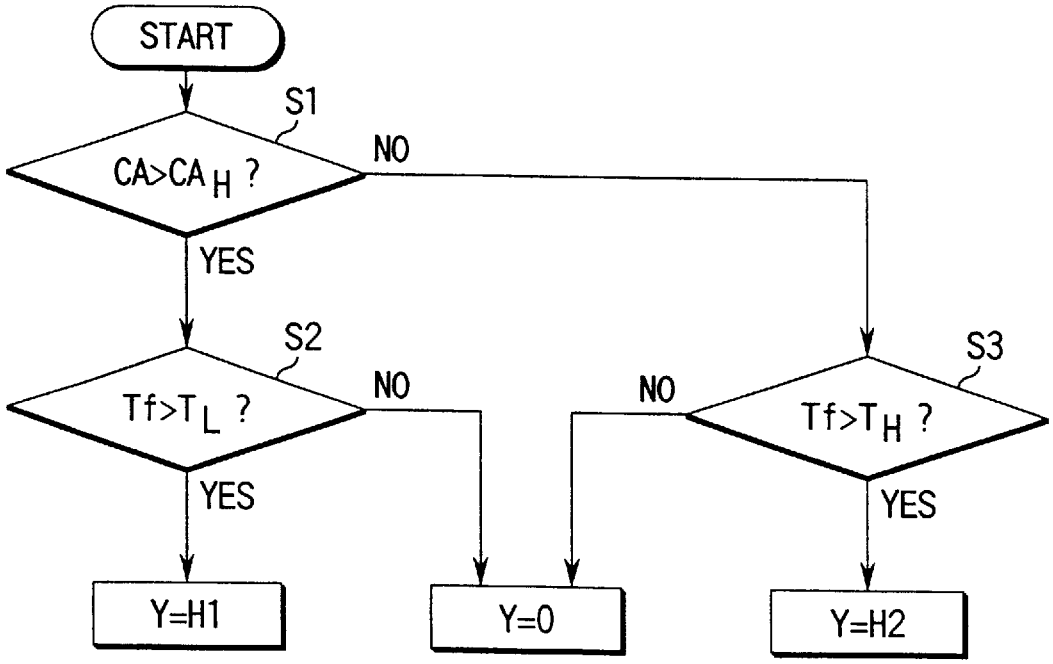
FIG. 3 is a schematic diagram of another example of the flowchart of the controlling steps in the waste incineration method according to the present invention.

FIG. 3 is a schematic diagram of the flowchart showing the conditions of TABLE 2.

As shown in the figure, it is judged by following the flowchart from START in constant cycle that each condition of S1, S2, and S3 is satisfied. At the final stage, the correction amount Y is determined, and the present value $R_k$ of the water spraying amount is obtained from the correction amount Y and the immediately previous value $R_{k-1}$ of the water spraying amount.

In FIG. 3, CA represents the concentration of a chlorinated aromatic compound, and $T_f$ represents the furnace interior temperature. Further, $CA_H$ is the adjustment parameter to judge the concentration of a chlorinated aromatic compound is above an upper limit. $T_H$ and $T_L$ are parameters to judge the furnace interior temperature is above an upper limit and below a lower limit, respectively. $H_1$ and $H_2$ are adjustment parameters which give a decrement and an increment in the amount f water sprayed, respectively.

The control of the amount of water sprayed will now be described with reference to FIG. 3.

In step S1, a judgement is made on a condition, CA (the concentration of chlorinated aromatic compound)>$CA_H$ (the upper limit value of the concentration of chlorinated aromatic compound). If the condition is satisfied, the operation proceeds to step S2. If not the operation proceeds to step S3. In step S2, a judgement is made on a condition, $T_f$ (the furnace interior temperature)>$T_L$ (the lower limit value of the furnace interior temperature). If the condition is satisfied, Y is set to $H_1$ in accordance with the Rule 1 of TABLE 2. If the condition is not satisfied, Y is set to 0. In step S3, a judgement is made on a condition, $T_f$ (the furnace interior temperature)>$T_H$ (the upper limit identification value of the furnace interior temperature). If the condition is satisfied, Y is set to $H_2$ in accordance with the Rule 2 of TABLE 2. If the condition is not satisfied, Y is set to 0.

Then, the correction amount Y is determined. The present value $R_k$ of the water sprayed amount is obtained from the correction amount Y and the previous value $R_{k-1}$, based on the following equation:

$$R_k=R_{k-1}+Y$$

As described above, the optimal water spraying amount $R_k$ for suppressing the generation of a chlorinated aromatic compound, that is, dioxins, in the combustion furnace 11 is obtained.

It should be noted in connection with the above-described method that the chlorinated aromatic compound measuring device 12 may be a real-time automatic analyzing meter capable of measuring chlorinated aromatic compounds in substantially real time. As a result, the combustion can be controlled more suitably and the chlorinated aromatic compound can be reduced more effectively.

Further, in the combustion incineration method according to the embodiment of the present invention, the amount of chlorinated aromatic compounds generated in the combustion furnace 11 of the incineration device 10, and the oxygen concentration and/or furnace interior temperature are measured. Then, it is judged the excessive or insufficient amount of the combustible supplied to the combustion furnace 11 and/or the combustion air supplied to the combustion furnace 11, based on the measured amount of the generated compounds. Then, the amount of the supplied combustible and/or the amount of supplied combustion air are adjusted on the basis of the judgment.

Further, if a water spraying mechanism is provided in the combustion furnace, the amount of water sprayed can also be adjusted. With adjusters 14, 15 and this mechanism, the supplied combustible amount and/or the supplied combustion air amount to the combustion furnace 11, the water spraying amount can be maintained to such an appropriate values to make the amount of chlorinated aromatic compounds generated extremely small. As a result, the generation of chlorinated aromatic compounds, that is, dioxins, in the incineration apparatus, can be further suppressed.

Next, the suppression of the generation of dioxins with use of the second CA measuring device 25 provided on the exit of the bag filter 22 will now be described.

A high-temperature exhaust gas 23 exhausted from the combustion furnace 11 is guided to exhaust gas cooler 21, and cooled down by water spray in the cooler 21. In the bag filter 22, dioxins are removed from the cooled exhaust gas 23, together with ash, dust and the like. Further, activated carbon pieces are supplied into the exhaust gas 23 from the activated carbon supply 24 situated prior to the bag filter 22 to eliminate dioxins.

The feedback control means 26 periodically measures the chlorinated aromatic compound measurement signals 27 obtained from the second CA measuring device 25. Then, the temperature of the exhaust gas cooled, which is the operating temperature of the bag filter 22, and/or the amount of activated carbon supplied are set such that the concentration of chlorinated aromatic compounds is equal to a preset value or less. The feedback control device 26 is, for example, a computer.

In this example, based on the measured concentration of chlorinated aromatic compounds, the concentration of dioxins is estimated. If the concentration of dioxins in the exhaust gas 23 is detected to be high, the bag filter 22 is operated at a low temperature and the amount of activated carbon supplied is increased, so as to reduce the concentration of dioxins.

Alternatively, the concentration of dioxins can be reduced by either operating the bag filter 22 at a low temperature, or increasing the amount of activated carbon supplied, in accordance with the amount of dioxins generated.

Figure 4:
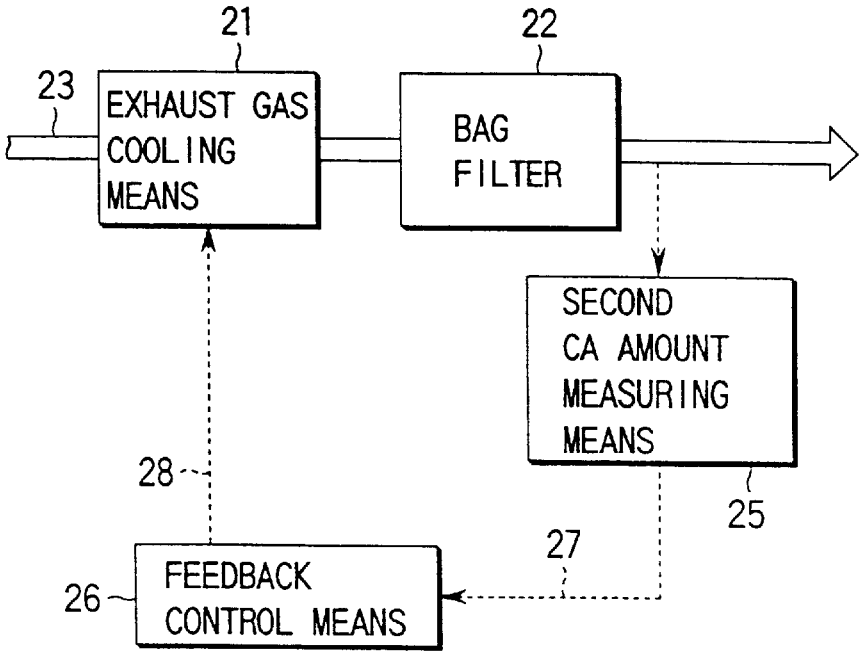
FIG. 4 is a schematic block diagram of an embodiment of controlling the suppression of dioxins from the waste incineration furnace of the present invention.

FIG. 4 is a block diagram illustrating an example of the feedback control. In the feedback control device 26, an exhaust gas cooling temperature setting signal 28 is calculated on the basis of a CA measurement signal 27. The setting signal 28 thus calculated is input to the exhaust gas cooler 21 to set the operating temperature of the bag filter 22 at the temperature corresponding to the setting signal 28.

Figure 5:
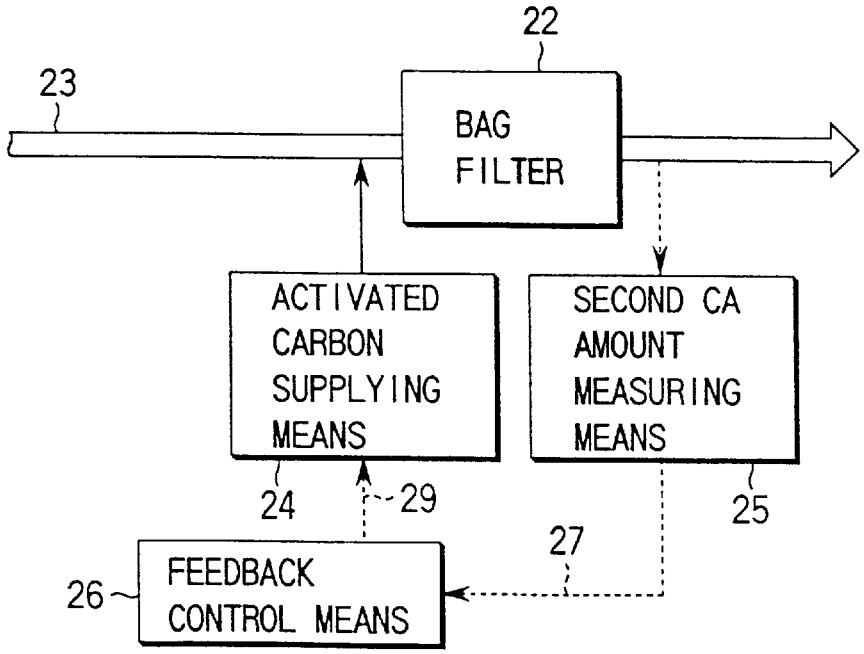
FIG. 5 is a schematic block diagram of another embodiment of controlling the suppression of dioxins from the waste incineration furnace of the present invention.

FIG. 5 is d block diagram illustrating another example of the feedback control. In the feedback control device 26, an activated carbon supply amount setting signal 29 is calculated on the basis of a CA measurement signal 27. The setting signal 29 thus calculated is input to the activated carbon supplying means 24 to set the amount of activated carbon to be supplied at the supply amount corresponding to the setting signal 29.

Figure 6:
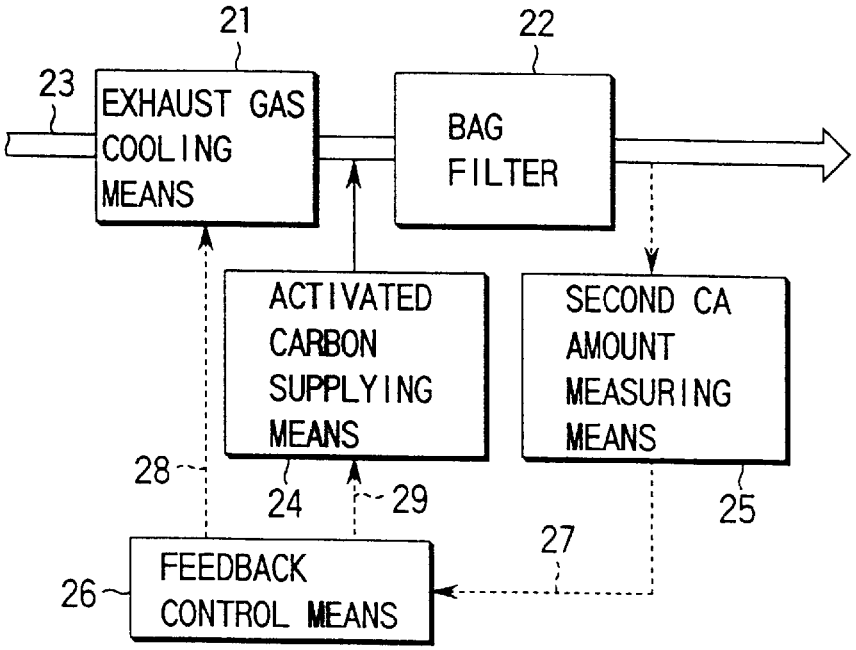
FIG. 6 is a schematic block diagram of another embodiment of controlling the suppression of dioxins in the waste incineration furnace of the present invention.

FIG. 6 is a block diagram illustrating still another example of the feedback control. In the feedback control device 26, an exhaust gas cooling temperature setting signal 28 and an activated carbon supply amount setting signal 29 are calculated on the basis of a CA measurement signal 27. The setting signals 28 and 29 thus calculated are input to the exhaust gas cooling means 21 and the activated carbon supplying 24, respectively to adjust the operating temperature of the bag filter 22 and the amount of activated carbon to be supplied at the same time.

Next, specific examples of the feedback control will now be described.

First, the control method for determining an exhaust gas cooling temperature setting signal 28 by periodically measuring CA measurement signals 27 in the feedback control device 26 shown in FIG. 4, such that the concentration of a chlorinate aromatic compound becomes a predetermined concentration, will now be described. The exhaust gas cooling temperature setting signal 28 is the operating temperature of the bag filter.

The feedback control means 26 forms the FID control system as expressed by the equation (1) below. To the PID control system, a chlorinated aromatic compound measurement signal 27 and the deviation of set values of a chlorinated aromatic compound are input.

$$u1 = \frac{100}{PB1}\left(1 + \frac{1}{Ti1s} + Td1s\right)(X_{set} - X) \tag{1}$$

where u1 represents an output value of the feedback control, that is, an exhaust gas cooling temperature setting signal 28. $X_{set}$ is a set value of a chlorinated aromatic compound and X is a measured value of a chlorinated aromatic compound. PB1, Ti1 and Td1 are control parameters representing proportional gain, integrated time and differentiated time, respectively.

Next, the control method for determining an activated carbon supply amount setting signal 29 by periodically measuring CA measurement signals 27 in the feedback control device 26 shown in FIG. 5, such that the concentration of a chlorinate aromatic compound becomes a predetermined concentration, will now be described. The activated carbon supply amount setting signal 29 is the activated carbon supply amount.

The feedback control means 26 forms the PID control system as expressed by the equation (2) below. To the PID control system, a chlorinated aromatic compound measurement signal 29 and the deviation of set values of a chlorinated aromatic compound are input.

$$u2 = \frac{100}{PB2}\left(1 + \frac{1}{Ti2s} + Td2s\right)(X_{set} - X) \quad (2)$$

where u2 represents an output value of the 15 feedback control, that is, an activated carbon supply amount setting signal 29. $X_{set}$ is a set value of a chlorinated aromatic compound and X is a measured value for a chlorinated aromatic compound. PB2, Ti2 and Td2 are control parameters representing proportional gain, integrated time and differentiated time, respectively.

Next, the control method for determining an exhaust gas cooling temperature setting signal 28 and an activated carbon supply setting signal 29 by periodically measuring CA measurement signals 27 in the feedback control device 26 shown in FIG. 7, such that the concentration of a chlorinate aromatic compound becomes a predetermined value, will now be described.

The feedback control means 26 forms the PID control systems as expressed by the equations (3) and (4) below. To the PID control system, a chlorinated aromatic compound measurement signal 27 and the deviation of set values of a chlorinated aromatic compound multiplied by a weight coefficient K (0<K<1), are input. The equation (3) is directed to the PID control system for determining the exhaust gas cooling temperature setting signal 28. The equation (4) is directed to the PID control system for determining the activated carbon supply amount setting signal 29. The weight coefficient K is determined as to which of the operating temperature of the bag filter and the amount of activated carbon supplied is more important, on the basis of the operating conditions of the waste incineration plant.

$$u1 = \frac{100}{PB1}\left(1 + \frac{1}{Ti1s} + Td1s\right)K(X_{set} - X) \quad (3)$$

$$u2 = \frac{100}{PB2}\left(1 + \frac{1}{Ti2s} + Td2s\right)K(X_{set} - X) \quad (4)$$

where U1 represents an output value of the feedback control, that is, an exhaust gas cooling temperature setting signal 28, and u2 represents another output value of the feedback control, that is, an activated carbon supply amount setting signal 29; $X_{set}$ is a set value of a chlorinated aromatic compound and X is a measured value of a chlorinated aromatic compound; PB1, Ti1 and Td1 are control parameters representing proportional gain, integrated time and differentiated time, respectively; and PB2, Ti2 and Td2 are control parameters representing proportional gain, integrated time and differentiated time, respectively.

In connection with the present invention, tests were carried out for confirming the effect of reducing the generation of dioxins in the waste incineration process with use of the incineration apparatus, and the following are descriptions of the tests.

Figure 7:
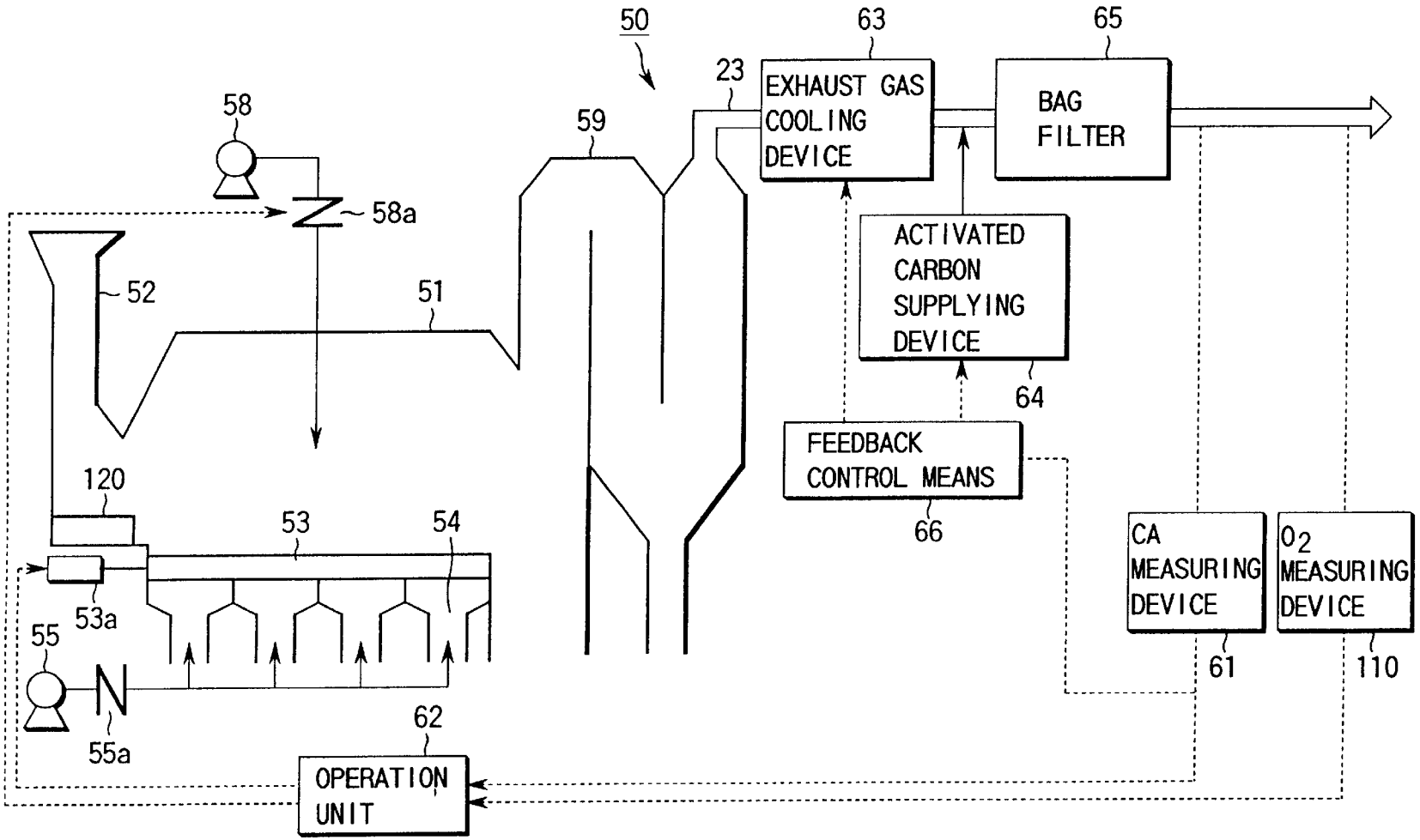
FIG. 7 is a schematic view of a structure of a stoker-type waste incineration apparatus used in the example of the present invention.

FIG. 7 is a schematic diagram showing the stoker type waste incineration apparatus 5 used in the examples.

At the entrance side of the combustion chamber 51, a waste supplying pusher 120 for supplying waste charged in a waste charging hopper 52, to a fire grate, and a fire grate 53 for incinerating waste pieces sent from the pusher by rocking the waste pieces one after another, are provided. The fire grate 53 is equipped with a fire grate rate adjusting device 53*a* capable of supplying the waste on the fire grate at an arbitrary rate. As the supply source of combustion air, a primary combustion air supply unit 55, a primary combustion air amount adjusting 55*a,* a secondary combustion air supply unit 58 and a secondary combustion air amount adjusting 58 are provided. The primary combustion air supply unit 55 and the primary combustion air amount adjusting 55*a* supply the primary combustion air onto the fire grate 53, via an air-flow box 54 divided into four sections in the combustion chamber 51. The second combustion air supply unit 58 and the secondary combustion air amount adjusting unit 58*a* supply the secondary combustion air to a space region in the combustion chamber 51.

At the exit side of the combustion chamber 51, a boiler 59 is connected. After the boiler 59, an exhaust gas cooling device 63, an activated carbon supplying device 64 and a bag filter 65 are installed in this order.

In the waste incineration device 50, a chlorinated aromatic compound (CA) measuring device 61 for measuring chlorinate aromatic compounds generated in the combustion chamber 51 and an oxygen concentration ($O_2$) measuring device 110 for measuring an oxygen concentration are installed. An arithmetic unit 62 is electrically connected to the CA measuring device 61 and the $O_2$ measuring device 110 so that measurement data signals can be transmitted from the device 61, 110 to the unit 62. From the CA measuring device 61, the data of the amount of chlorinated aromatic compound generated is transmitted to the operation unit 62, the fire grate rate adjusting device 53*a* serving as means for adjusting the amount of waste supplied, and the secondary combustion air amount adjusting device 58*a* serving as means for adjusting the combustion air amount supplied are electrically connected such that control signals from the operation unit 62 can be transmitted to the device 53*a* and 58*a*.

Further, to the CA measuring device 61, a feedback control device 66 is electrically connected such that a measurement data signal can be transmitted from the device 61 to the device 66. To the feedback control device 66, the exhaust gas cooling device 63 and the activated carbon supplying device 64 are electrically connected such that control signals from the feedback control device 66 can be transmitted to the device 63 and 64.

EXAMPLE 1

First, the correlation between dioxins and chlorobenzenes was examined.

In the waste incineration apparatus 50 such as described above and shown in FIG. 7, waste was combusted in the combustion furnace 51, and an exhaust gas 23 generated from the combustion furnace 51 was analyzed with the CA measuring device 61, which is, a real-time measuring device. A signal of 2,8-dichlorodibenzofuran, which is one of the dioxins, was produced from the CA measuring device 61. Then a signal of monochlorobenzene, which is one of the chlorobenzenes, was produced. The correlation between those products was then examined. Further, similar tests were carried out on tetrachlorobenzene and pentachlorobenzene.

The laser multiple photon ionization mass spectrometry technique was used as the real-time measuring method for dioxins and chlorobenzenes. The sampling position for the exhaust gas 23 was placed at the exit of the bag filter 65. The exhaust gas was sucked at that position with a pump at 1 liter/minute, and the sample introduction unit for the laser multiple photon ionization mass spectrometer was connected on the way to the pump. The sample introduction unit included a nozzle having a diameter of 0.8 mm, a pulse valve which opens intermittently, and a high vacuum section. Detection signals were produced at a rate of once per 10 second. The measurement value was the summation of the detection signals over 10 seconds.

The way of measuring dioxins was as follows. The pulse valve was opened intermittently at a rate of 50 times per second for 250 μsec. When the pulse valve is opened, a molecular jet which has been cooled down close to absolute zero is created. The molecular jet was irradiated with a dye laser beam for 150 fsec in synchronism with the opening of the pulse valve. The dye laser was excited with a YAG laser. The dye laser beam was made of two lasers of different colors, each of which had a wavelength of 303.3 nm and 210 to 220 nm, respectively, and a laser energy of about 5 mJ. After the laser unit, a flight-time type mass spectrometer was provided, in order to detect (using counting method) 2,8-dichlorodibenzofuran ionized under the aforementioned conditions. The mass spectrometer was of a reflectron type, with a flight distance of 2000 mm, and included a micro-channel plate as a detector.

The way of measuring chlorobenzenes was as follows. The pulse valve was opened intermittently at a rate of 10 times per second for 2 msec. A molecular jet created was irradiated with a dye laser beam for a 5 nsec in synchronism with the opening of pulse valve. The dye laser was excited with a YAG laser. The dye laser beam had a wavelength of 269.8 nm, and a laser energy of about 2 mJ. After the laser unit, a flight-time type mass spectrometer having a flight distance of 450 mm was provided, in order to detect chlorobenzenes are ionized under the aforementioned conditions. Otherwise, the way of measuring was similar to the way of measuring dioxins.

Figure 8:
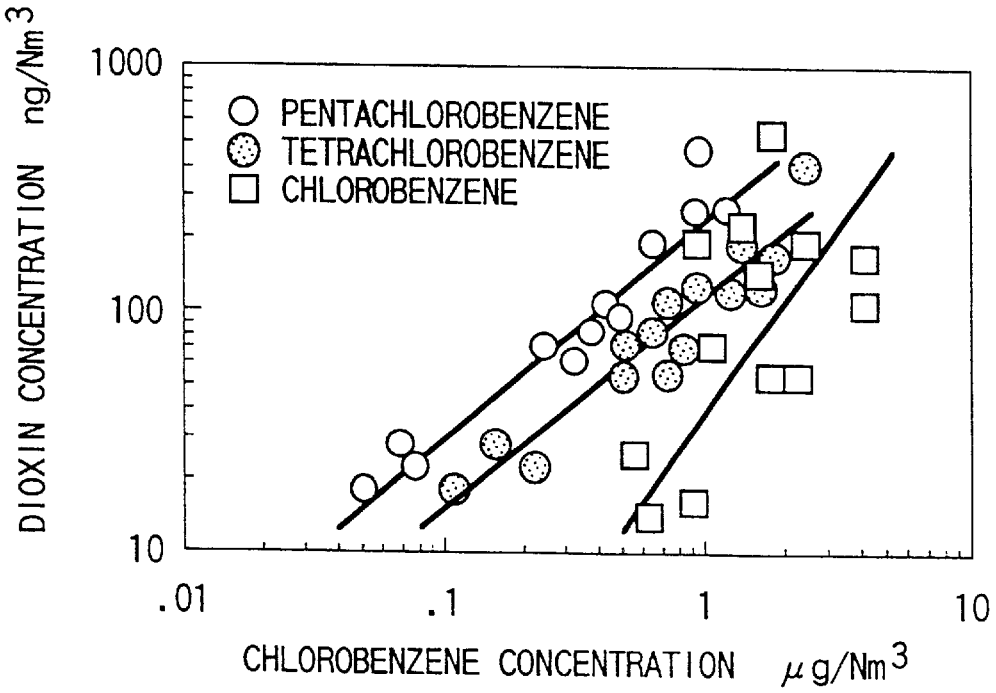
FIG. 8 is a graph illustrating the correlation between the concentrations of dioxins and chlorobenzenes, which are obtained in Example 1 of the present invention.

The results of the measurements are shown in FIG. 8.

The vertical axis indicates the concentration (unit: $ng/Nm^3$) of 2,8-dichlorodibenzofuran, which is one of dioxins, and the horizontal axis indicates the concentration (unit: $ng/Nm^3$) of monochlorobenzene, which is one of chlorobenzenes. From FIG. 8, it is clear that a strong correlation exists between the concentration of dioxins and that of monochlorobenzenes.

The results of the measurements for tetrachlorobenzene and pentachlorobenzene are also shown in FIG. 8. From FIG. 8, it is clear that a stronger correlation than the above exists between the concentration of dioxins and that of tetrachlorobenzenes and pentachlorobenzenes.

EXAMPLE 2

In the waste incineration apparatus 50 shown in FIG. 7 as described above, detection signal of 2,8-dichlorodibenzofuran, which is one of dioxins, were produced from the CA measurement device 61, and oxygen concentration detection signals were produced from the $O_2$ measuring device 110. Both of the detection signals were produced at a rate of once per 10 seconds. The measurement value was the summation of the detection signals over 10 seconds. Those signals were sent to the arithmetic unit 62, and the arithmetic was carried out according to the arithmetic way indicated by the control rule in TABLE 1. The waste was combusted in such a way that, the fire grate speed was adjusted so as to adjust the amount of waste supplied, and the amount of secondary combustion air was adjusted so as to adjust the amount of combustion air, such as to decrease the amount of dioxins generated.

The measurement of the amount of 2,8-dichlorobenzofuran generated was carried out in the same manner as in Example 1. The measurement of oxygen concentration was carried out using an oxygen concentration meter (not shown) provided at the exit side of the bag filter 65.

Figure 9:
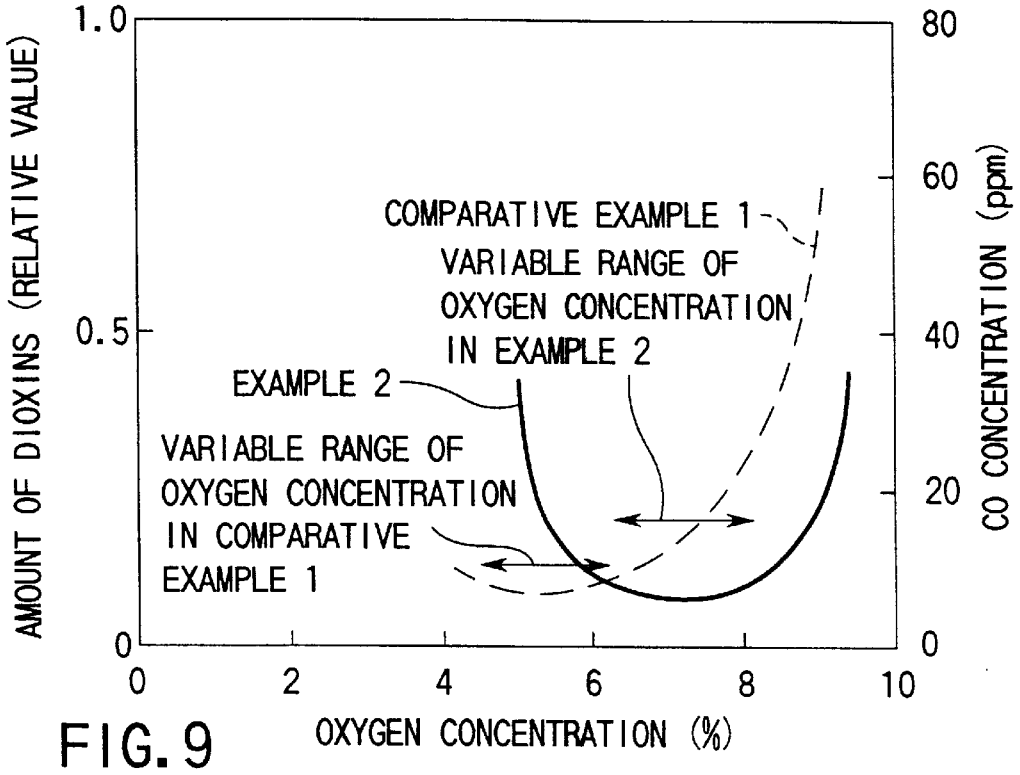
FIG. 9 is a characteristic diagram illustrating a change i the concentration of dioxins or CO with respect to the oxygen concentration of the incineration exhaust gas, which is obtained in Example 2 and Comparative Example 1 of the present invention.

FIG. 9 is an illustration of the operation state during the measurement. The variation of the oxygen concentration measured with the oxygen concentration meter was 6.3 to 8.3%. Under this operation state, the exhaust gas was sampled for 2 hours from the exit side of the bag filter 65 operated at a temperature of 190 to 210° C. according to the U.S. EPA method. Then obtained sample gas was analyzed with the analyzing method usually employed for dioxins analysis to measure the amount of dioxins generated. The analyzing method is based on a concentration and clean-up process in a manual analysis and the quantitative analysis with the high-performance gas chromatography mass spectrometer. The results are summarized in TABLE 3.

Comparative Example 1

In the same waste incineration apparatus 50 as in Example 2, signals from CO measurement means (not shown) provided at the exit side of the bag filter 65 were sent to the operation unit 62, in place of signals from the dioxins measurement device 61. The waste was combusted in such a way that the waste supply rate and the amount of combustion air were varied according to the combustion control based on the fuzzy control such as to decrease the CO generation. This operation state is also illustrated in FIG. 9. The variation of the oxygen concentration measured was 4.6 to 6.6%, which is slightly different from that of Example 2. Under this operation state, the exhaust gas was sampled according to the U.S. EPA method to measure the amount of dioxins generated, in a similar way to Example 2. The results are summarized in TABLE 3.

TABLE 3

| | The results of measurement of the dioxins concentration | |
|---|---|---|
| | Example 2 | Comparative Example 1 |
| Dioxins Concentration ($ng\text{-}TEQ/Nm^3$) | 0.06 | 0.11 |

As is clear from TABLE 3, with the incineration method using the incineration apparatus 50 in Example 2, the concentration of dioxins was further decreased as compared to Comparative Example 1.

EXAMPLE 3

In the waste incineration apparatus 50 shown in FIG. 7 as described above, detection signals of monochlorobenzene, which is one of chlorobenzenes, were produced from the CA measurement device 61, and oxygen concentration detection signals were produced from the $O_2$ measuring device 110. Both of the detection signals were produced at a rate of once per 10 seconds. The measurement value was the summation of the detection signals over 10 seconds. Those signals were sent to the arithmetic unit 62, and the arithmetic was carried out according to the arithmetic way indicated by the control rule in the above TABLE 1. Then, the waste was combusted in such a way that the fire grate rate was adjusted so as to adjust the amount of waste supplied, and the amount of secondary combustion air was adjusted so as to adjust the amount of combustion air, such as to decrease the amount of chlorobenzenes generated.

The measurement of the amount of monochlorobenzene generated was carried out in the same manner as in Example 1. The measurement of oxygen concentration was carried out with the oxygen concentration meter provided at the exit side of the bag filter 65.

Figure 10:
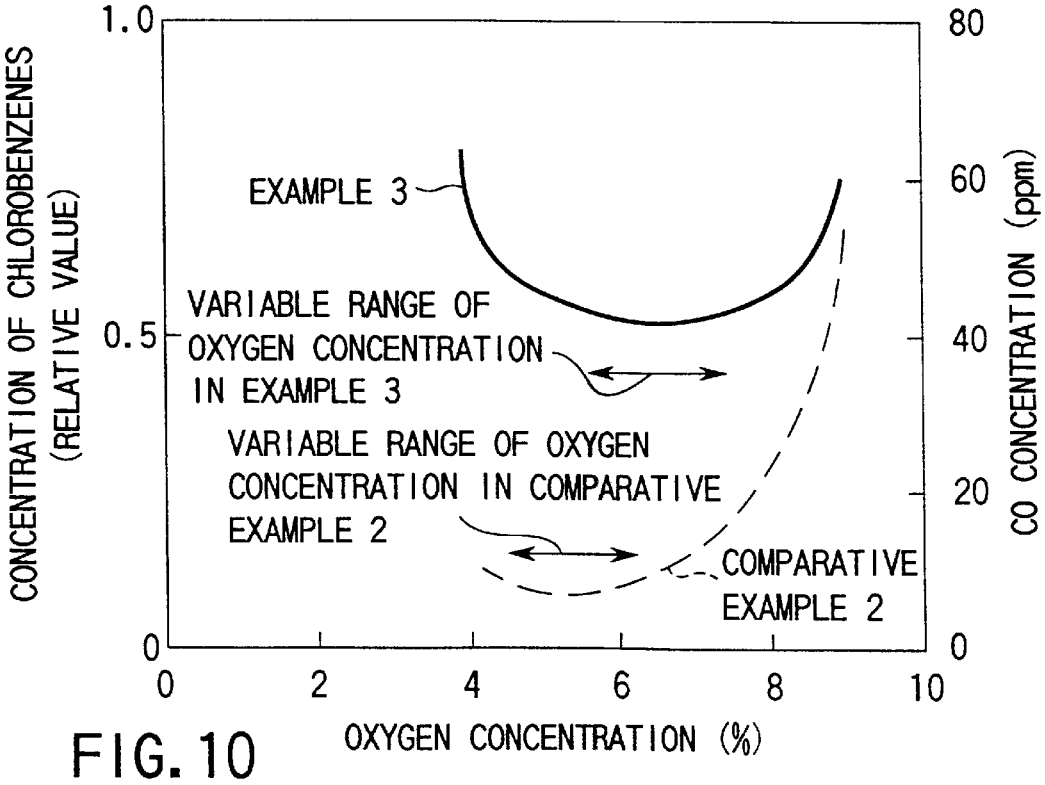
FIG. 10 is a characteristic diagram illustrating a change in the concentration of chlorobenzenes or CO with respect to the oxygen concentration of the incineration exhaust gas, which is obtained in Example 3 and Comparative Example 2 of the present invention.

FIG. 10 is an illustration of the operation state during the measurement. The variation of the oxygen concentration measured with the oxygen concentration meter was 6.1 to 8.1%. Under this operation state, the exhaust gas was sampled from the sampling pore at the exit side of the bag filter 65 operated at a temperature of 200° C., to measure the amount of dioxins generated, in a similar manner to that of Example 2. The results are summarized in TABLE 4.

Comparative Example 2

As in Comparative Example 1, CO signals were sent to the arithmetic unit 62 in place of signals of the dioxins. Then, the waste was combusted in such a way that the waste supply rate and the amount of combustion air were varied according to the combustion control based on the fuzzy control such as to decrease the CO generation. This operation state is illustrated in FIG. 10. The variation of the oxygen concentration was 4.6 to 6.7%, which is slightly different from that of Example 3. Under the this operation states, the exhaust gas was sampled according to the U.S. EPA method, in a similar manner to that of Example 2 to measure the amount of dioxins generated. The results are summarized in TABLE 4.

TABLE 4

| | The results of measurement of the dioxins concentration | |
|---|---|---|
| | Example 3 | Comparative Example 2 |
| Dioxins Concentration (ng-TEQ/Nm$^3$) | 0.06 | 0.08 |

As is clear from TABLE 4, with the incineration method using the incineration apparatus 50 in Example 3, the concentration of dioxins was further decreased as compared to Comparative Example 2.

EXAMPLE 4

The correlation was examined between the dioxin removing rate and the operating temperature of the bag filter 65.

As in Example 1, the amount of dioxins in the exhaust gas, that is, 2,8-dichlorodibenzofuran, was measured while burning waste in the combustion furnace 51. The measurement was carried out at the entrance and exit of the bag filter 65. Then, the ratio of the amount measured at the exit of the bag filter 65 to the amount measured at the entrance was obtained to obtain a dioxins removing rate with bag filter 65. Then, the dioxins removing rate was examined for various operating temperature of the bag filter 65. The various operating temperature of the bag filter 65 was obtained by setting various temperature of the exhaust gas 23 with the exhaust gas cooling device 63.

Figure 11:
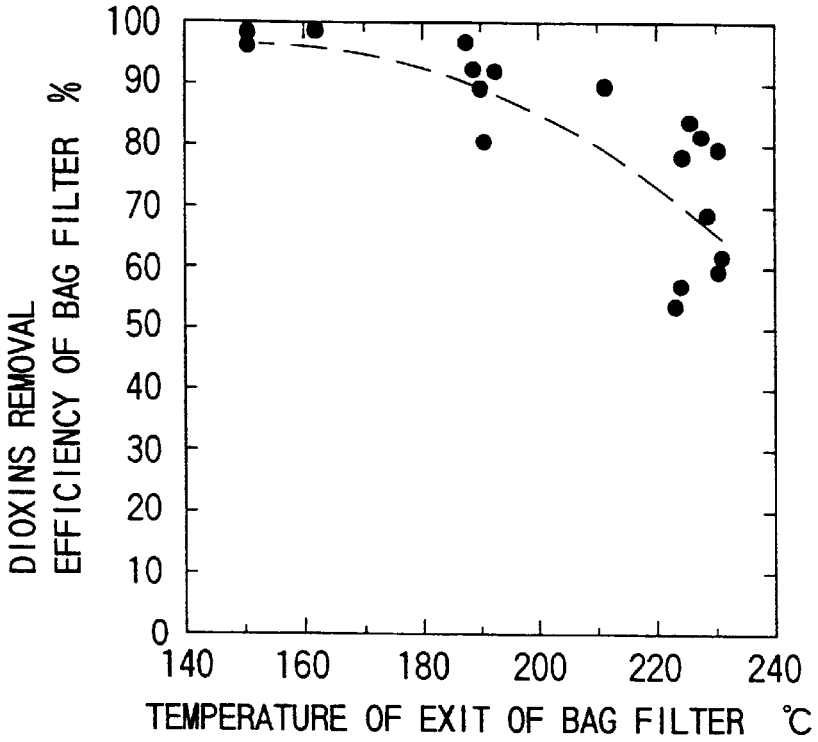
FIG. 11 is a diagram of the characteristics of the elimination of dioxins obtained in Example 4 of the present invention for the various operating temperature of the bag filter in the waste incineration apparatus.

The results are shown in FIG. 11. The vertical axis indicates the dioxins removing rate of the bag filter and the horizontal axis indicates the temperature at the exit of the bag filter 65. From FIG. 11, it is clear that as the operating temperature of the bag filter 65 decreases, the dioxins removing rate increases.

EXAMPLE 5

The correlation was examined between the concentration of dioxins and the amount of activated carbon supplied to the exhaust gas 23.

As in Example 1, the amount of a dioxin in the exhaust gas 23, that is, 2,8-dichlorodibenzofuran, was measured while burning waste in the combustion furnace 51. The measurement was carried out at the exit of the bag filter 65. Then, the concentration of dioxins in the exhaust gas 23 was examined for various amount of the activated carbon supplied to the exhaust gas 23. The various amount of activated carbon supplied was obtained with the activated carbon supply device 65.

Figure 12:
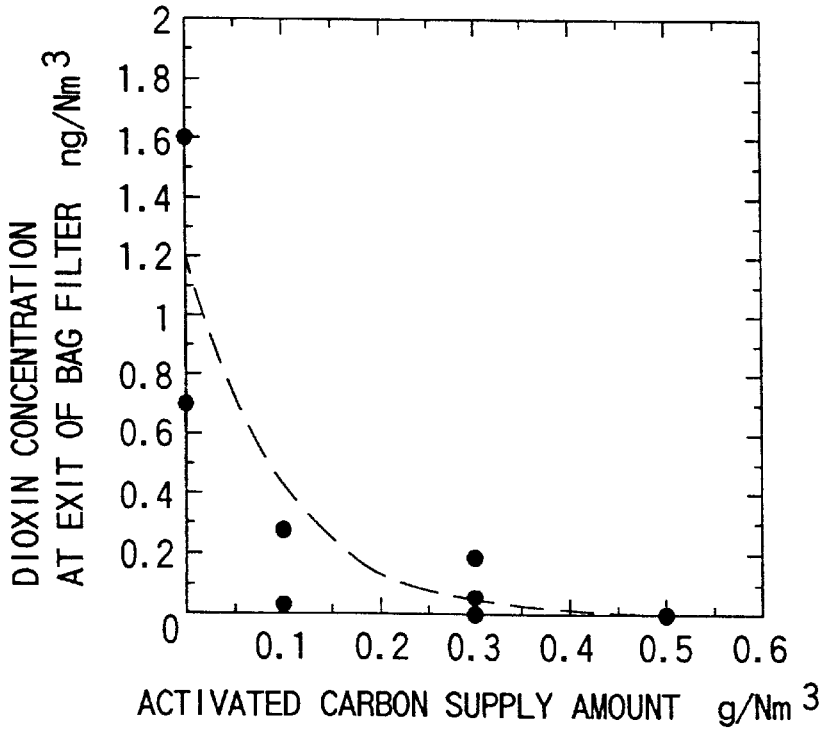
FIG. 12 is a diagram of the concentration characteristics of dioxins obtained in Example 5 of the present invention for the various amount of supply of activated carbon to the waste incineration apparatus is varied.

The results are shown in FIG. 12. The vertical axis indicates the dioxins concentration (unit: ng/Nm$^3$) at the exit of the bag filter 65 and the horizontal axis indicates the amount of activated carbon supplied (unit: ng/Nm$^3$). From FIG. 12, it is clear that as the amount of activated carbon supplied is increased, the dioxin concentration decreases.

As described above, according to the waste incineration apparatus and method according to the present invention, the combustion of waste is controlled so as to decrease the amount of chlorinated aromatic compounds, by measuring the amount of chlorinated aromatic compounds generated in the combustion furnace, of which chemical structures and production behaviors are similar to those of dioxins, by measuring the oxygen concentration in the combustion furnace and/or the furnace interior temperature, and by measuring the concentration of a chlorinated aromatic compound in the exhaust gas. Thus, the amount of dioxins generated in the waste combustion apparatus can be reduced.

What is claimed is:

1. A method for treating an exhaust gas from a combustion furnace comprising the step of passing the exhaust gas through a bag filter, said method further comprising the steps of:

measuring the concentration of a chlorinated aromatic compound selected from the group consisting of chlorobenzenes and chlorophenols in said exhaust gas; and adjusting the operating temperature of said bag filter based on the measured concentration of said chlorinated aromatic compound in order to decrease the concentration of said chlorinated aromatic compound in said exhaust gas.

2. The method according to claim 1, wherein said adjusting step employs feedback control.

3. The method according to claim 2, wherein said feedback control adjusts the operating temperature of said bag filter based on a periodically measured concentration of said chlorinated aromatic compound, so as to make the concentration of said chlorinated aromatic compound equal to or less than a preset level.

4. A method for treating an exhaust gas from a combustion furnace comprising the step of passing the exhaust gas through a bag filter, said method further comprising the steps of:

measuring the concentration of a chlorinated aromatic compound selected from the group consisting of tetrachlorobenzene and pentachlorobenzene in said exhaust gas; and adjusting the operating temperature of said bag filter based on the measured concentration of said chlorinated aromatic compound in order to decrease the concentration of said chlorinated aromatic compound in said exhaust gas.

5. The method according to claim 4, wherein said adjusting step employs feedback control.

6. The method according to claim 5, wherein said feedback control adjusts the operating temperature of said bag filter based on a periodically measured concentration of said chlorinated aromatic compound, so as to make the concentration of said chlorinated aromatic compound equal to or less than a preset level.

7. A method for decreasing the concentration of dioxins in an exhaust gas comprising the step of passing the exhaust gas from a combustion furnace through a bag filter, said method further comprising the steps of:

measuring the concentration of a chlorinated aromatic compound selected from the group consisting of chlorobenzenes and chlorophenols in said exhaust gas;

estimating the concentration of dioxins in said exhaust gas based on the measured concentration of said chlorinated aromatic compound; and adjusting the operating temperature of said bag filter based on the estimated concentration of dioxins to decrease the concentration of dioxins in said exhaust gas.

8. The method according to claim 7, wherein said adjusting step employs feedback control.

9. The method according to claim 8, wherein said feedback control adjusts the operating temperature of said bag filter based on a periodically measured concentration of said chlorinated aromatic compound, so as to make the estimated concentration of said dioxins equal to or less than a preset level.

10. A method for decreasing the concentration of dioxins in an exhaust gas comprising the step of passing the exhaust gas from a combustion furnace through a bag filter, said method further comprising the steps of:

measuring the concentration of a chlorinated aromatic compound selected from the group consisting of tetrachlorobenzene and pentachlorobenzene in said exhaust gas; and estimating the concentration of dioxins in said exhaust gas based on the measured concentration of said chlorinated aromatic compound; and adjusting the operating temperature of said bag filter based on the estimated concentration of dioxins to decrease the concentration of dioxins in said exhaust gas.

11. The method according to claim 10, wherein said adjusting step employs feedback control.

12. The method according to claim 11, wherein said feedback control adjusts the operating temperature of said bag filter based on periodically measured concentration of said chlorinated aromatic compound, so as to make the estimated concentration of said dioxins equal to or less than a preset level.

* * * * *